US006945442B2

(12) United States Patent
Godshaw et al.

(10) Patent No.: US 6,945,442 B2
(45) Date of Patent: Sep. 20, 2005

(54) FRAMED SOFT SIDED CARRIER FOR TOOLS

(75) Inventors: Donald E. Godshaw, Evanston, IL (US); Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 251 days.

(21) Appl. No.: 10/430,717

(22) Filed: May 6, 2003

(65) Prior Publication Data

US 2004/0040990 A1 Mar. 4, 2004

Related U.S. Application Data

(63) Continuation-in-part of application No. 09/838,908, filed on Apr. 20, 2001, now Pat. No. 6,571,998.
(60) Provisional application No. 60/198,966, filed on Apr. 21, 2000.

(51) Int. Cl.[7] ..... A45F 3/00
(52) U.S. Cl. ..... 224/607; 190/110; 206/372; 206/373; 224/581; 224/681; 224/257
(58) Field of Search ..... 224/581–583, 224/607, 611, 653, 257, 258, 678–683; 206/372–373; 383/13, 38, 121.1; 150/113; 190/110, 127

(56) References Cited

U.S. PATENT DOCUMENTS

| | | | | | |
|---|---|---|---|---|---|
| 3,963,102 | A | * | 6/1976 | Carp | 190/110 |
| 4,267,869 | A | * | 5/1981 | Behar | 383/121.1 |
| 4,629,040 | A | * | 12/1986 | Jones | 190/127 |
| 5,207,254 | A | * | 5/1993 | Fromm | 190/110 |
| 6,126,003 | A | * | 10/2000 | Brouard | 206/372 |
| 6,640,944 | B2 | * | 11/2003 | Adams | 190/110 |
| 2004/0065573 | A1 | * | 4/2004 | Brouard | 206/373 |

* cited by examiner

*Primary Examiner*—Nathan J. Newhouse
(74) *Attorney, Agent, or Firm*—Banner & Witcoff, Ltd.

(57) ABSTRACT

A collapsible bag or container includes first and second major pockets separated by a connecting web into which a metal frame is removably inserted. Alternatively, a plastic or rigid board member is substituted for the metal frame. Loops and handles project through the web for attachment of a carrier strap or manual handle.

6 Claims, 7 Drawing Sheets

FIG.2
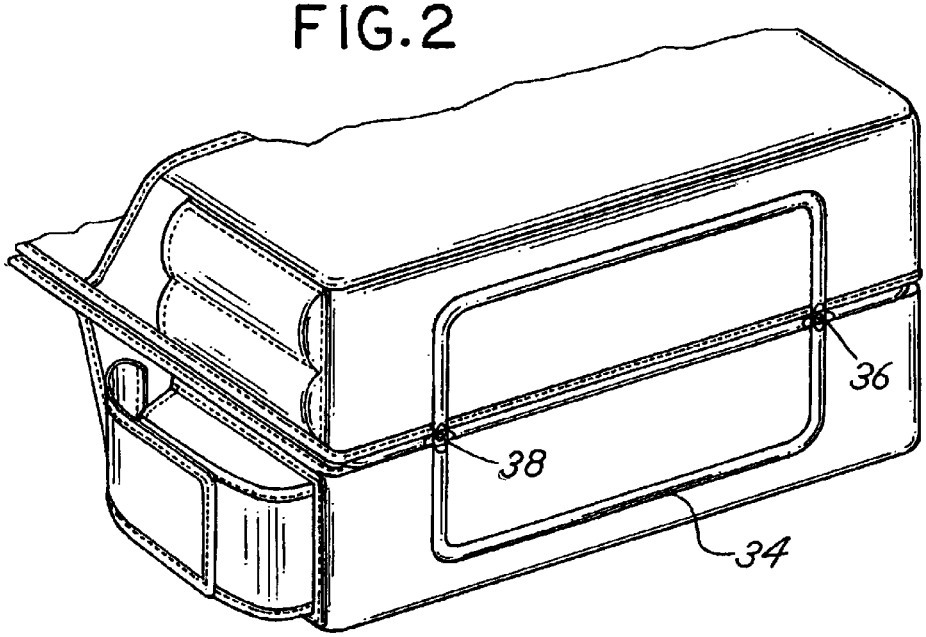
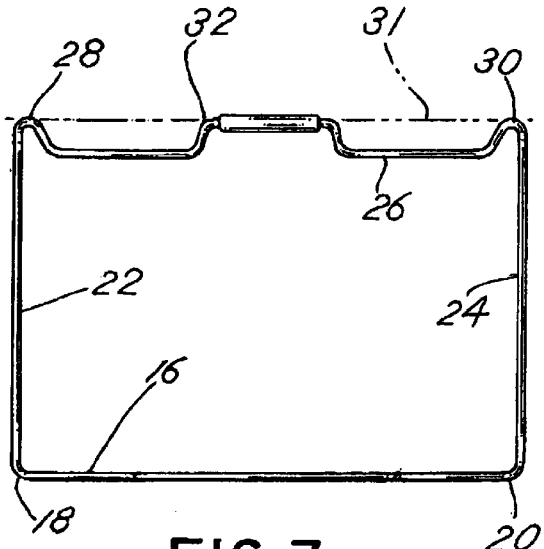
FIG.3
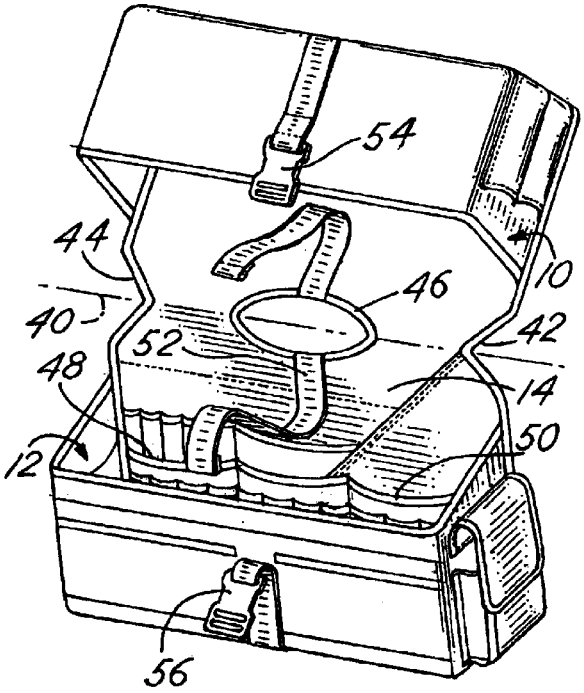
FIG.4

FIG. 5
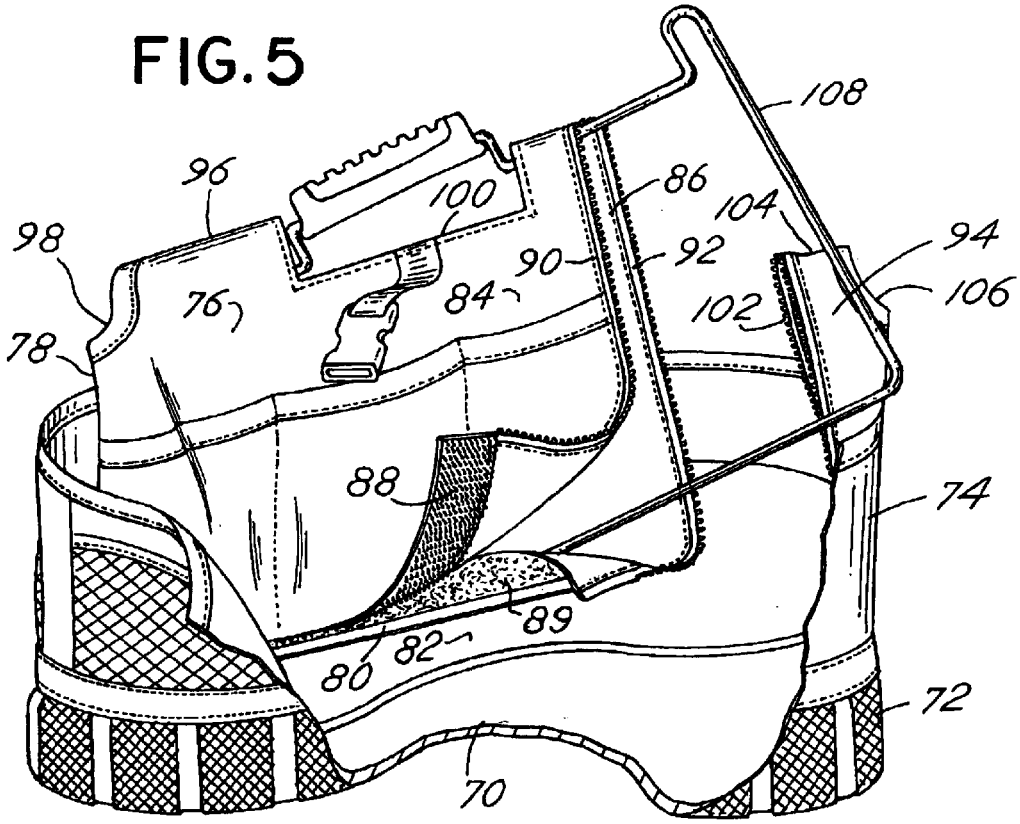
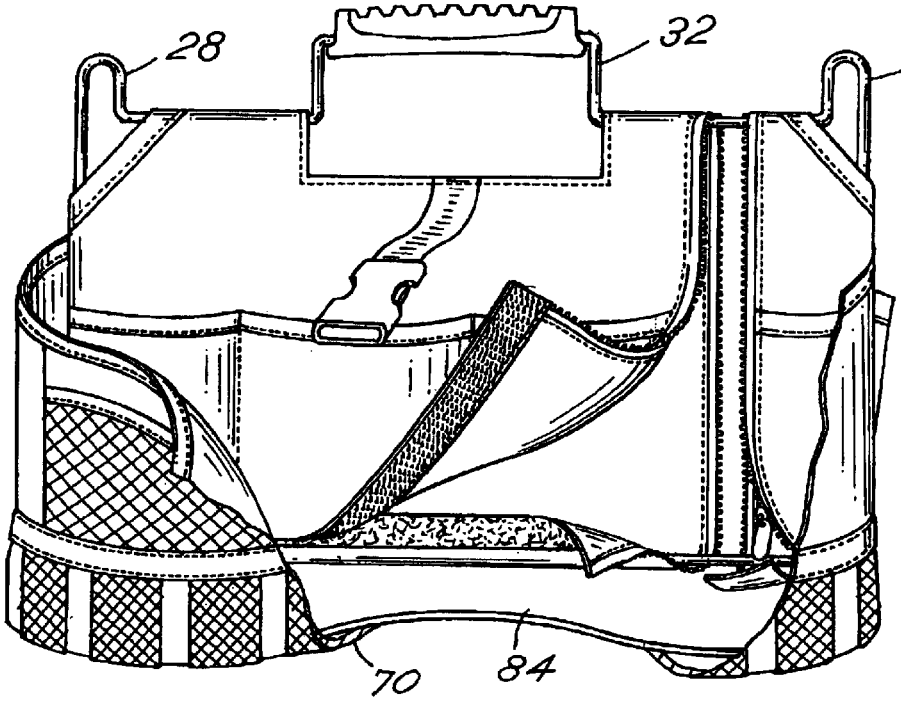
FIG. 6

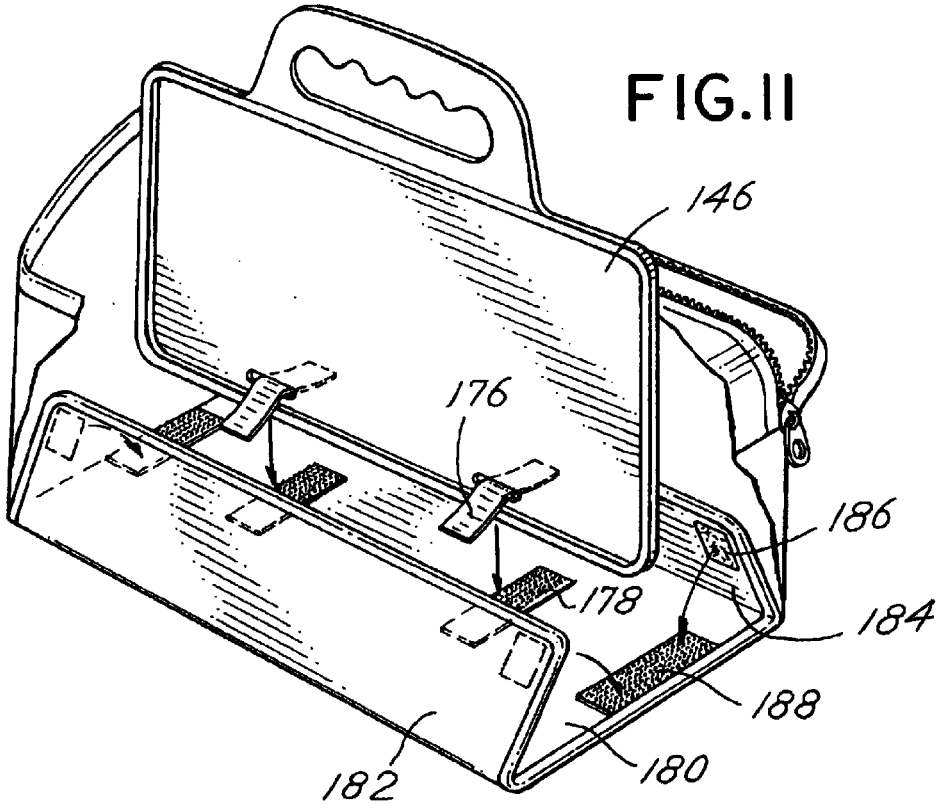
FIG.11
FIG.12
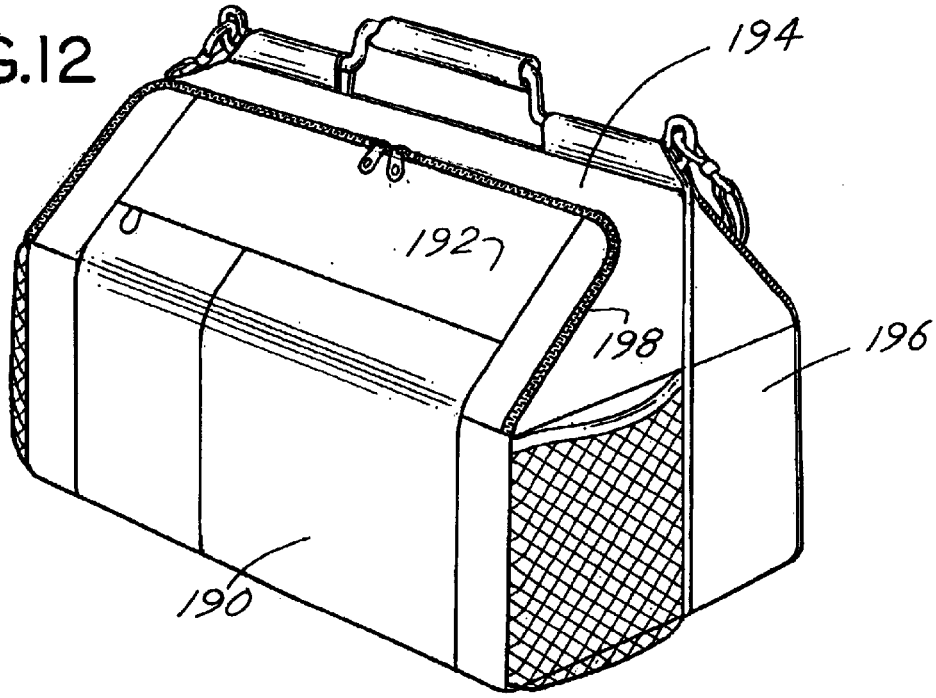

FRAMED SOFT SIDED CARRIER FOR TOOLS

CROSS REFERENCE TO RELATED APPLICATION

This is a continuation-in-part application of Ser. No. 09/838,908 filed Apr. 20, 2001, entitled "Framed, Soft Sided Carrier For Tools", now U.S. Pat. No. 6,571,998, which is a utility application and patent based upon previously filed provisional application Ser. No. 60/198,966 filed Apr. 21, 2000, each of which is incorporated herewith by reference and for which priority is claimed.

BACKGROUND OF THE INVENTION

In a principal aspect the present invention relates to a collapsible carrier for tools and other similar articles comprised of a flexible bag and a wire frame which is used in combination with the bag.

Tradesmen and craftsmen often find it necessary to carry multiple tools for practice of their trade. Various types of bags and containers have been developed to facilitate the transport of such tools. Often such bags or containers are fabricated from a fabric such as canvas or a vinyl material. Various designs of such containers or bags are available. Nonetheless there remains a need for improved designs and further the need for designs which are collapsible and may be folded for ease of transport and for appropriate ease of packaging in order to market the products.

SUMMARY OF THE INVENTION

Briefly, the present invention comprises a collapsible tool carrier or bag comprised of first and second principal, open top pockets with a connecting web separating the two separate, principal pockets. The web is constructed of opposed web panels that define an enclosure or slot. A wire frame is inserted in the enclosure or slot between the opposed panels. The frame includes loops that project from openings provided in top seam or the juncture between the opposed web panels. End loops in the frame are provided for a shoulder strap and a handle loop is incorporated at the middle of the frame. Various embodiments of the invention are depicted including an embodiment comprised of a flexible container having the configuration of a saddle bag, and a flexible sided container wherein the bottom of the container is rigid with a mid-panel or web pocket into which the wire frame is inserted and retained by means of a fastener such as a zipper. Other embodiments substitute rigid boards for the wire frame.

Thus it is an object of the invention to provide improved collapsible tool bag or container comprised of first and second main pockets separated by midpanel or web construction which is adapted to receive a reinforcing wire frame.

It is another object of the invention to provide a collapsible carrier bag or container which may include multiple pockets and straps to facilitate the storage and carriage of tools and items of various shapes and sizes.

Yet another object of the invention is to provide a collapsible tool bag or carrier which is economical, light weight, easy to assemble, easy to disassemble and package, and rugged.

These and other objects, advantages, and features of the invention will be set forth in a detailed description which follows.

BRIEF DESCRIPTION OF THE DRAWING

In the detailed description which follows, reference will be made to the drawing comprised of the following figures:

FIG. 2 is a bottom isometric view of the tool carrier of FIG. 1;

FIG. 3 is an elevation of the wire frame which is used in the collapsible tool carrier;

FIG. 4 is an isometric view of the fabric bag which is utilized with the wire frame of FIG. 3 to provide the collapsible tool carrier of the invention; and FIG. 5 is an isometric view of an alternative embodiment of the invention;

FIG. 6 is an isometric view of the embodiment of FIG. 5 partially assembled for use;

FIG. 11 is an isometric view of an alternative frame construction utilized in the fabrication of an embodiment of the type depicted in FIG. 8; and FIG. 12 is an isometric view of an embodiment of the invention utilizing insulated, flexible, fabric walls to provide a carrier which can serve as a cooler or insulated bag.

DESCRIPTION OF THE PREFERRED EMBODIMENTS

Figure 1:
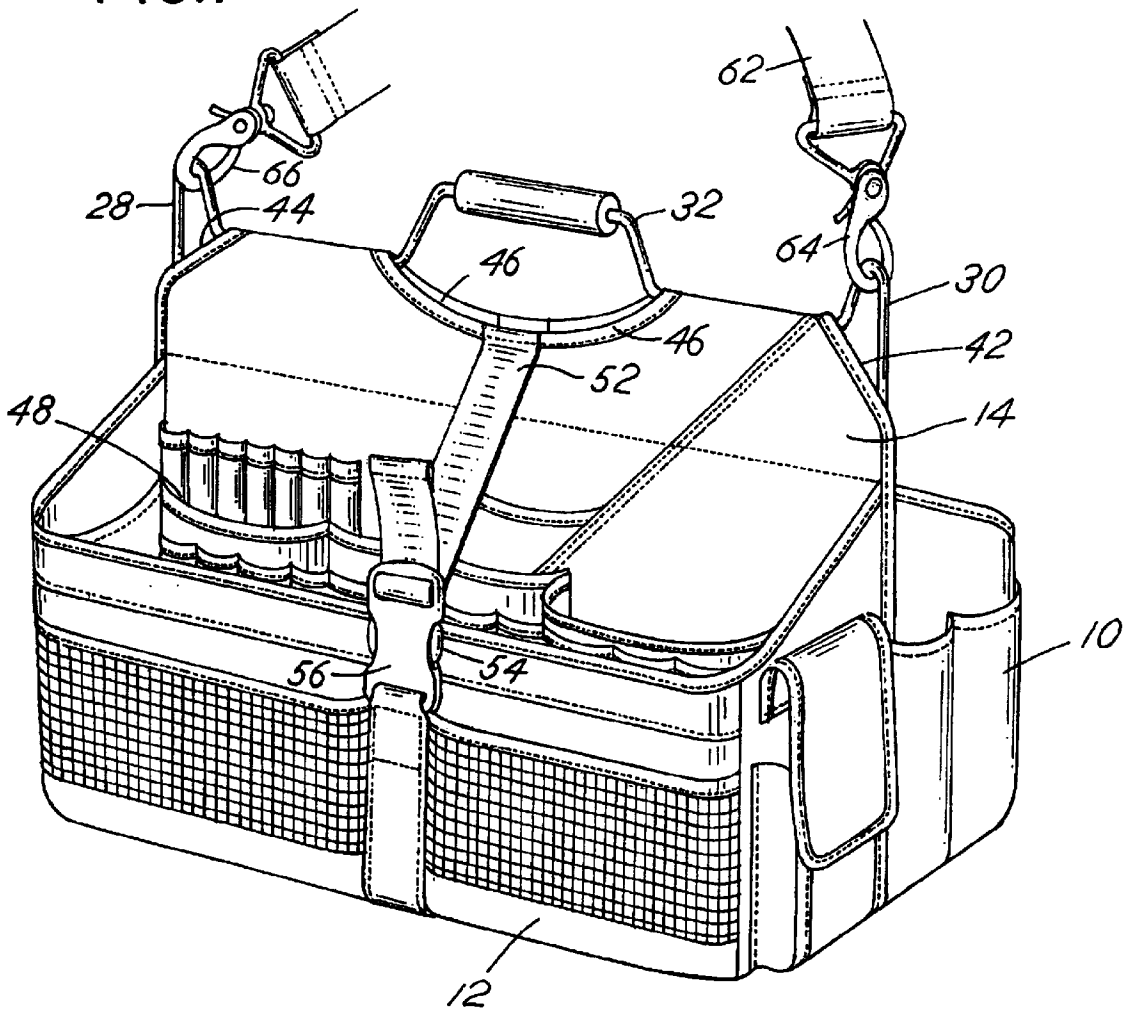
FIG. 1 is an isometric view of the assembled collapsible tool carrier of the invention.

Referring to the figures, the collapsible portable tool carrier of the invention is comprised of two basic component parts: a wire frame, such as depicted in FIG. 3 and a fabric bag having first and second separate pockets 10 and 12 and a connecting web 14 between the pockets 10, 12 as depicted in FIG. 4. The following description of a first embodiment will be directed to the wire frame to be followed by a description of the fabric bag.

The wire frame includes a straight bottom run 16 having first and second spaced ends 18 and 20. A first frame side 22 extends upwardly from the end 18. A second parallel, spaced frame side 24 extends upwardly from the end 20. The frame sides 22 and 24 are connected by a top run 26. The top run 26 includes a first end loop 28 and a second, spaced end loop 30 at the junction, respectively, of the top run 26 and the side frame run 22 and the top run 26 and the side frame run 24. A middle handle section 32 in the form of a loop is defined in the top run 26. The loops 28, 30, as well as the handle section 32 are generally aligned along a line 31 which is spaced from and parallel to the bottom run 16. An optional rectangular frame 34 is affixed to the bottom run 16 transversely thereto and connected by screws or fasteners 36 and 38.

Referring next to FIGS. 1 and 4, there is depicted in greater detail the construction of the fabric bag or carrier. The fabric bag may be constructed from a material such as canvas or the like. The bag includes a first pocket 10 and a separate second pocket 12 separated and connected by a connecting web 14. The connecting web 14 defines a middle axis 40. In a preferred embodiment of the invention, the axis 40 is an axis of symmetry of the pockets 10 and 12. The bag assembly thus has the form of a saddle bag.

The web 14 includes a first notch 42 on one side thereof and a second notch 44 on the opposite side thereof. An intermediate opening 46 is defined on the axis 40 between the notches 42 and 44. Each pocket 10, 12 may include a series of pouches or subpockets, such as subpockets 48 and 50 for holding various tools. Web 14 further includes a strap 52 attached thereto extending from opening 46 with a connector 54 which may be attached to a strap and connector 56 attached to the outside of pocket 12 to hold the tools and the pocket 12 in a supported condition. The pocket 10 has a similar symmetric construction through the arrangement and configuration of ancillary pockets or pouches may be varied.

It will be noted by referring to FIG. 1 that the web 14 is folded over the top run 26 of the frame with the handle 32 projecting through the opening 46 and the loops 28 and 30 projecting through the notches 44 and 42, respectively. A carrying strap 62 with attachment clips or latches 64 and 66 may then be attached to the loops 28 and 30 for support of the bag.

Figure 7:
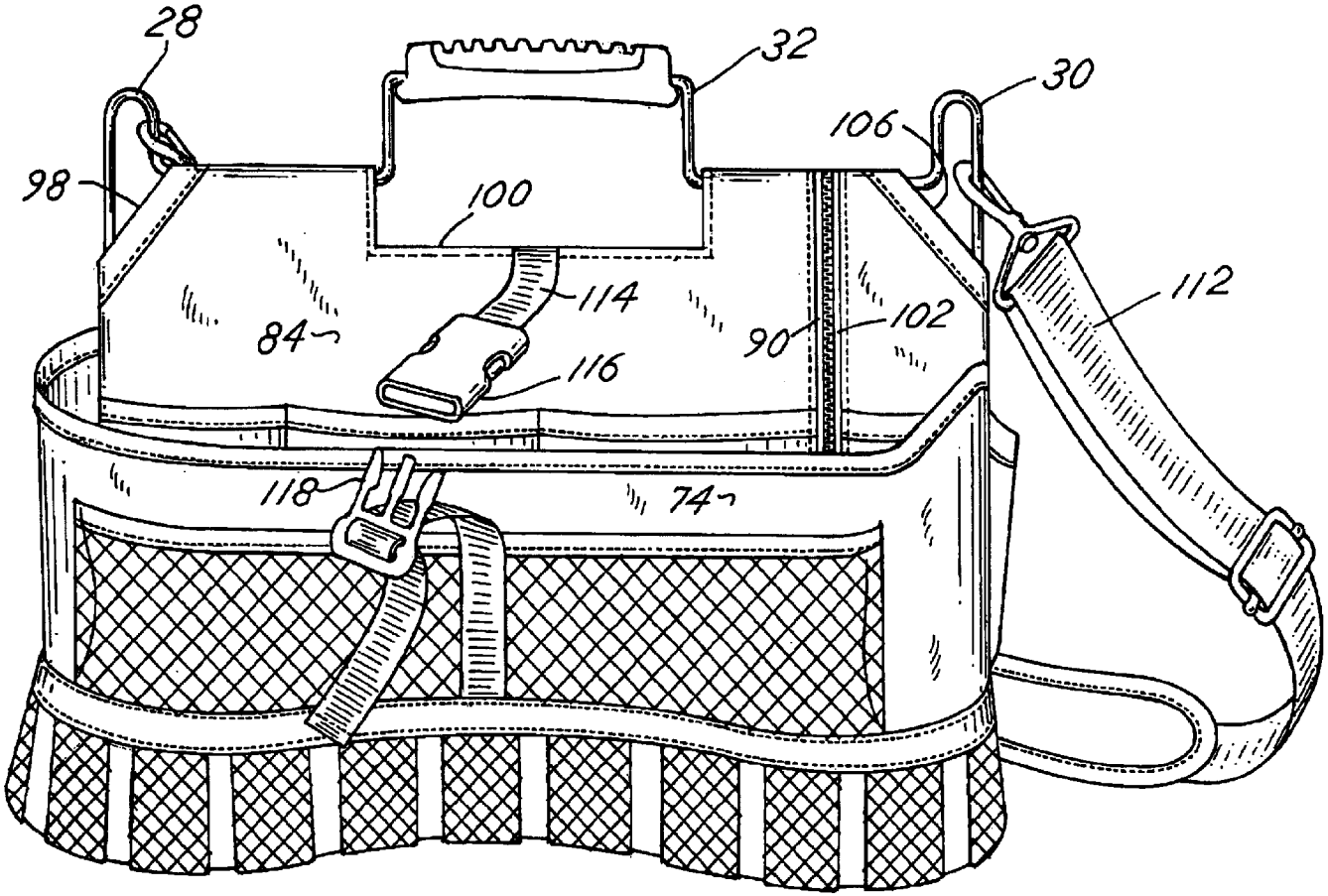
FIG. 7 is an isometric view of the embodiment of FIG. 5 fully assembled for use.

Next referring to FIGS. 5, 6 and 7 there is depicted an alternative embodiment of the invention. In this embodiment, a bottom 70 of the bag is formed from a generally rigid material such as molded rubber or plastic material. The configuration of the bag may thus be controlled or adjusted by means of the shape of the bottom 70. For example, the profile of the bottom 70 may be that of a kidney shape so that the bag may easily be carried by a worker or tradesman on his or her hip. That is, a kidney shaped bag will have a concave side which will easily fit against the hip of a worker for transport of the bag.

The bottom 70 may include peripheral, upstanding side flange 72 around the circumference of the bottom 70. Circumferential side wall 74 is attached to the flange 72 and extends upwardly to define the interior or enclosure of the bag. The side wall 74 is comprised of a flexible material such as canvas fabric or a vinyl material. Of course, pockets may be formed up of both the inside and outside of the peripheral or circumferential side wall 74.

Positioned within the interior of the enclosure defined by the side wall 74 is a central or midpanel or web 76 which substantially divides the collapsible bag into equal sized, major pockets within the enclosure defined by the side wall 74. The midpanel or web 76 includes a first edge 78 which is preferably attached to the side wall 74 on the inside thereof. Optionally, the web 76 includes a bottom edge 80 which is attached to a rigid planar insert 82 attachable to the inside surface of bottom 70. The insert 82 may be lifted or detached from the bottom 70. The web 76 includes a first sheet or panel 84 and a separate sheet or panel 86, a fastener 88, such as a Velcro fastener, is provided along the lower edge 80 for coaction with a fastener 89 to enclose the tubular enclosure defined by the separate sheets or panels 84 and 86.

The separate sheets 84 and 86 each include a second or inside edge or side 90 and 92, respectively. The edges 90 and 92 may be joined or attached to a midplane web extension 94. The tubular enclosure defined by the panels 84 and 86 further includes a top edge 96 having cut out openings 98, 100 therein. The cut out opening 100 is substantially at the midpoint of the distance between the sides of the enclosure wall or panel 74.

The panel web extension 94 comprises a tubular member, or in other words compatible side sheets or panels to web 76 and a zipper fastener 102 along an edge thereof cooperative with the zipper fastener 90, 92 of the midpanel web 76. The web extension 94 further includes a top edge 104 with an open passageway or opening 106.

A frame 108 having a construction similar to the frame depicted in FIG. 3 is provided to fit within the tube enclosure defined by the panels 84 and 86 and the web extension 94. Thus the zipper connection 90, 92, 102 is first disconnected. The frame 108 is then inserted in the tube of web 76 and extension 94 and fitted in the manner depicted in FIG. 6 so that the end loop 28, 30 as well as the handle 32 are fitted through the appropriate openings 98, 100, and 106. The zipper connection 90, 92, 102 is closed thereby encompassing the frame 108. The insert or base 82 may then be fastened to bottom 70.

A carry strap 112 may be attached to the loops 28, 30. A pocket retention strap 114 fixed to the web 84 includes a fastener 116 connectible with a fastener 118 attached to the side panel 74. This is a strap construction similar to the first embodiment previously described.

Both the first and second embodiments may thus be easily assembled or disassembled. For the second embodiment of FIGS. 5 and 6, removal of the frame 108 by detaching or unfastening the zipper 90, 92, 102 and removing the fasteners 88, 90 will permit the removal of the frame 108. In this manner, the entire assembly and more particularly the peripheral side wall 74 may be folded with the midpanel or connecting web 76 into a flat condition and placed in a packing box for display. Thus the assembly provides a rigid shaped tool carrier bag when assembled yet on the other hand may be disassembled for ease of packaging, storage, etc.

Figure 8:
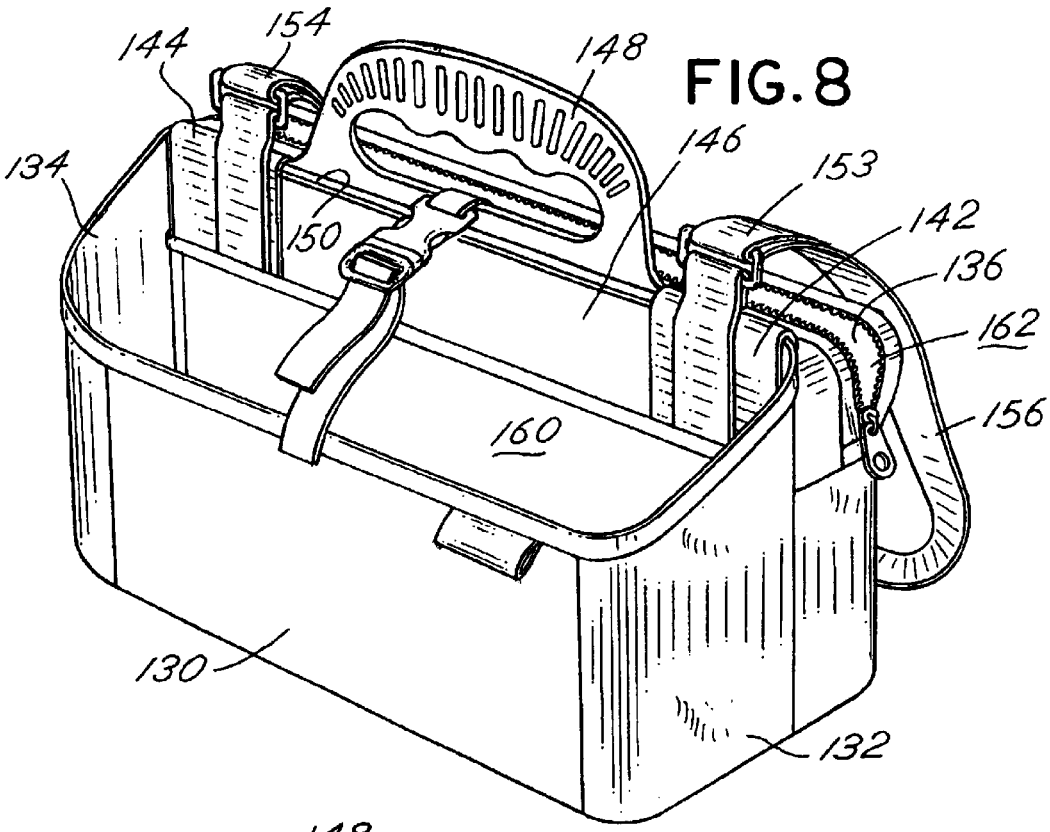
FIG. 8 is an isometric view of a further alternative embodiment of the invention utilizing a rigid plastic internal frame member.
Figure 9:
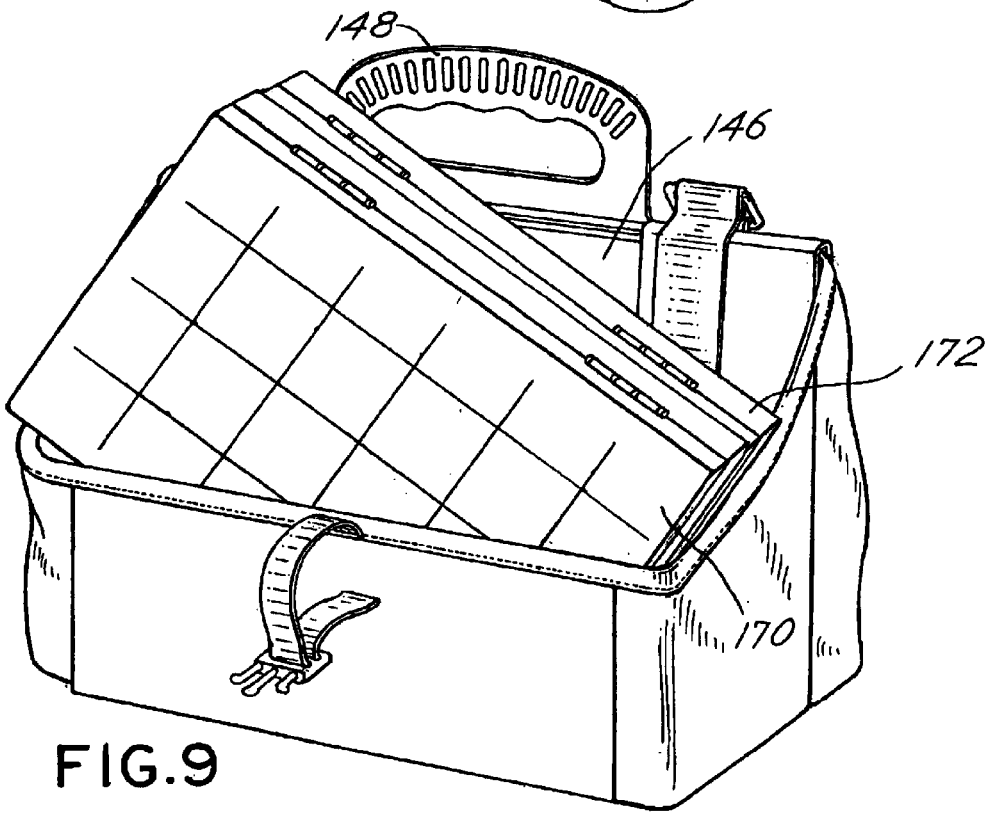
FIG. 9 is an isometric view of an embodiment of the type shown in FIG. 8 further including modular sized, separate molded plastic containers incorporated in combination with the carrier.
Figure 10:
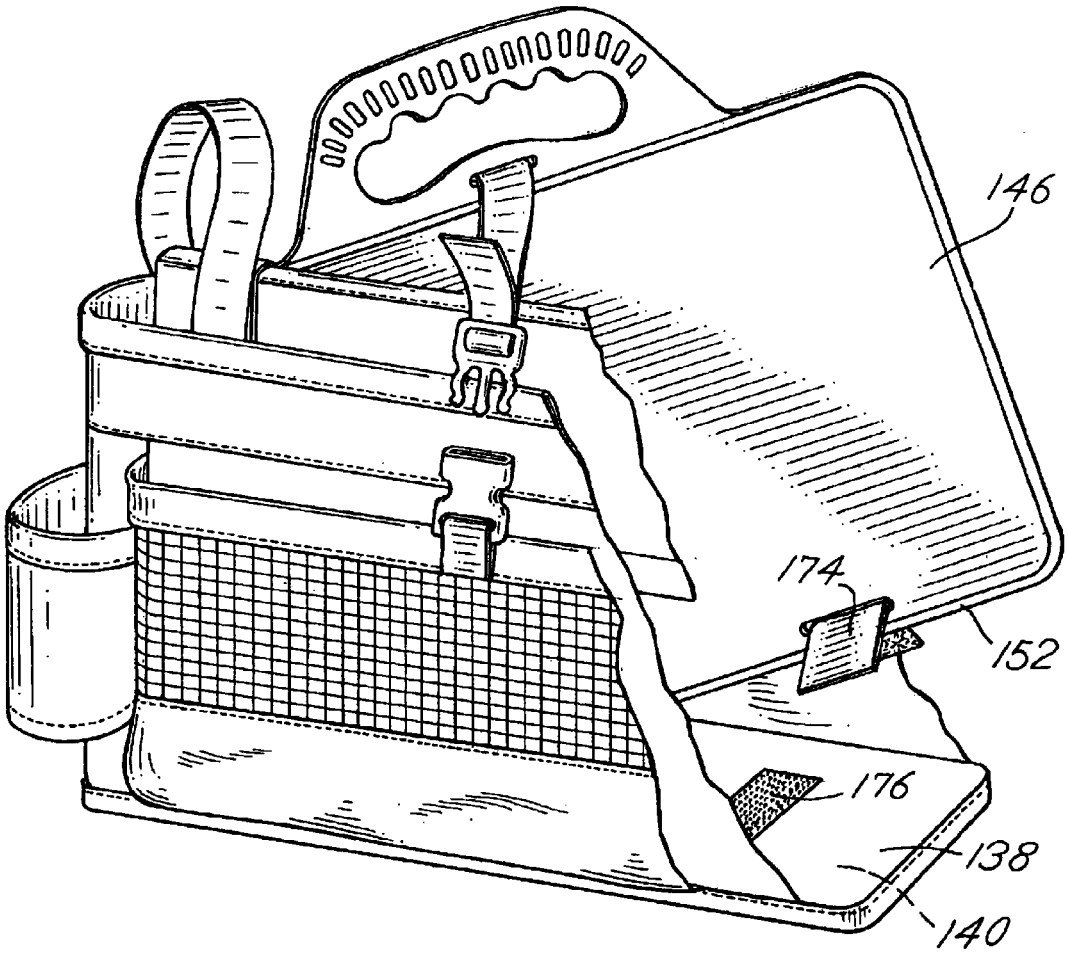
FIG. 10 is an isometric view of the embodiment of FIG. 8 partially cut away and sectioned to reveal the construction of the carrier.

FIGS. 8–10 illustrate, in general, another alternative embodiment of the invention. In this alternative embodiment, the carrier includes a flexible fabric material front wall 130, a first flexible fabric lateral or side wall 132 and a second flexible fabric lateral or side wall 134 generally parallel to and spaced from the first flexible fabric side wall 132. The carrier further includes a flexible fabric back side wall 136 generally parallel to and spaced from the front or forward flexible fabric wall 130. A bottom wall, for example, bottom wall 138 in FIG. 10 is also included as a component part of the carrier. The bottom wall 138 may be formed from a flexible fabric material as are the other walls. Alternatively, the bottom wall 138 may comprise a flexible fabric material with a rigid board, for example, a board member 140 encapsulated or sewn into a flexible fabric material as depicted, for example, in FIG. 10. Alternatively, the bottom wall 138 may be a flexible fabric material with a board rested thereon. Yet a further alternative is depicted in FIGS. 5–7 wherein the bottom wall comprises a rigid molded material wall as previously described.

In any event, the carrier includes a mid-panel comprised of a first major pocket 142 and a second, opposed major pocket 144. The pockets 142 and 144 are positioned on a plane which constitutes a mid plane halfway between the flexible front wall panel 130 and the flexible back wall panel 136 generally parallel thereto and spaced equally from the respective panel walls 130, 136. The pockets 142 and 144 each comprise flexible fabric material which is sewn into the lateral side walls 132 and 134 with openings exposed or directed toward one another so that a rigid board 146 or wire frame may be inserted into the pockets 142 and 144 thereby providing structural integrity to the carrier. The rigid board 146 may be of molded plastic material with a molded handle 148 along an upper margin 150. A lower margin 152 will then be adjacent the bottom wall 138 as depicted in FIG. 10. The board 146 may be a molded plastic panel or fabricated from a wire material or a rod material, and thus be in the form of a wire frame, such as the embodiments depicted in FIGS. 1–4. The pockets 142 and 146 may include a strap 153 and 154 sewn thereto and connected to a shoulder strap 156, for example. The construction therefore provides a first compartment 160 adjacent the front wall 130 and a second compartment 162 adjacent the back wall 136. The compartments 160 and 162 are generally equal in size. They are also preferably accessible from the top of the carrier and may, or may not, include top flaps or covers enclosing the compartments. Thus, the carrier, when filled with items, will facilitate the balance thereof.

The compartments 160 and 162 may receive, by way of example, modular molded storage boxes 170 and 172. In such an embodiment, the storage boxes 170 and 172 may, for example, be fishing tackle boxes which are maintained within the compartments 160 and/or 162, as depicted in FIG. 9.

FIG. 10 illustrates one of the alternative constructions for attaching a board member or frame member 146 to bottom wall 138. Hook and eyelet tabs 174 associated with the lower margin 152 of the frame member 146 engage hook and/or eyelet members 176 (e.g. Velcro fasteners) associated with the bottom wall, or bottom panel 138. This enables attachment of the rigid frame member 146 to the bottom wall 138, the frame member also being held by virtue of the pockets 142 and 144 as previously described.

FIG. 11 illustrates another alternative construction wherein frame member 146 includes hook and eyelet tabs 176 which engage with tabs 178. This arrangement facilitates holding the frame member 146 in position. FIG. 11 illustrates the further feature of providing a board 180 for use in combination with, or as part of, the bottom wall 138 wherein the board 180 includes articulating side panels 182 and 184 which include hook and eyelet fastening elements 186, by way of example, which engage with hook and/or eyelet fastening elements 188 on the bottom panel 180. Each of the panels 180, 182 and 184 are generally rigid panels. The panels 182 and 184 are one half or semi-sized with respect to the bottom panel 180 thus define a means for positioning the frame member with the carrier and provide a rigid bottom wall construction in combination with a rigid, vertical frame member 146, again, which may be used in combination with the flexible fabric walls previously described.

FIG. 12 illustrates that the flexible bag or wall material used for the carrier may include insulated or padded fabric walls. For example, a front wall 190 made from a flexible insulated fabric material will include an upper margin or flap 192 which connects with a closure flap 194 incorporated as an extension of a lateral side wall 196. A zipper 198 enables detachment of the flap 192 from the extension section 194 for access to the interior of the carrier depicted in FIG. 12. Thus, the overall combination of elements lends itself to multiple variations and uses including the use as an insulated carrier as depicted in FIG. 12.

As depicted in the figures, the collapsible fabric bag may include pockets of various size and description for holding various types of tools. Subpockets or pouches may be positioned on the outside of the collapsible bag or inside the bag. Thus, while there has been set forth a preferred embodiment of the invention, it is to be understood that the invention is to be limited only by the following claims and equivalents thereof.

What is claimed is:

1. A portable carrier comprising, in combination:

a flexible bag including a bottom wall, a flexible fabric front wall, a flexible fabric back wall, a first flexible fabric connecting lateral side wall and a second flexible fabric connecting lateral side wall;

a flexible fabric mid-wall section generally parallel to and generally midway between the front wall and the back wall, said mid-wall section including a first retention pocket extending from the first lateral side wall and a second retention pocket extending from the second lateral side wall, each pocket including a pocket opening into the interior of the carrier;

a frame member fitted simultaneously into the first and second pocket openings, said frame member defining a generally rigid mid panel which in combination with said pocket openings separates the carrier into first and second compartments, said frame member including a lower margin at the bottom wall and an upper margin with a handle for the carrier.

2. The carrier of claim 1 wherein the frame member is a rigid board member.

3. The carrier of claim 1 wherein the carrier bottom wall includes a rigid material wall.

4. The carrier of claim 1 wherein the bottom wall comprises a rigid material including a board member forming the bottom wall and further including semi bottom wall panels connected to the board member and foldable over the bottom wall within each separate compartment.

5. The carrier of claim 1 including fastening elements attaching the frame member to the bottom wall.

6. The carrier of claim 5 wherein the fastening elements comprise hook and eyelet tabs connecting the lower margin to the bottom wall.

* * * * *